United States Patent [19]

Kobayashi

[11] 4,016,618

[45] Apr. 12, 1977

[54] GOLF BALL WASHING MACHINE

[76] Inventor: Tadashi Kobayashi, 1560-2 Tenma, Fuji, Shizuoka, Japan

[22] Filed: Feb. 26, 1976

[21] Appl. No.: 661,694

[52] U.S. Cl. ..... 15/21 A

[51] Int. Cl.[2] ..... A63B 47/04

[58] Field of Search ..... 15/21 A, 97 R, 160

[56] References Cited

UNITED STATES PATENTS

| | | | |
|---|---|---|---|
| 1,366,306 | 1/1921 | Wick | 15/21 A X |
| 1,796,704 | 3/1931 | Day | 15/21 A |
| 1,954,738 | 4/1934 | Lerch | 15/21 A |

*Primary Examiner*—Edward L. Roberts
*Attorney, Agent, or Firm*—George B. Oujevolk

[57] ABSTRACT

A golf ball washing machine, comprising a circular golf ball wash chamber at the center of which are rotatably provided a lower brush disc and a central brush cylinder coaxially therewith, the inner peripheral surface of said wash chamber being detachably provided with a flexible belt-like brush plate.

5 Claims, 9 Drawing Figures

GOLF BALL WASHING MACHINE

This invention relates to a golf ball washing machine for washing soiled golf balls.

More particularly, this invention relates to a golf ball washing machine comprising a circular golf ball wash chamber in the center of which is provided a lower brush disc, a central brush cylinder concentrically with the brush disc, and further a circular brush plate provided so as to encircle them circumferentially, and enabling to put golf balls to be washed into between the central brush cylinder and the circular brush plate so that the golf balls may be pressed against the brush portion of the lower brush disc, rotating thereafter the lower brush disc and the central brush cylinder simultaneously, whereby each of the golf balls is rotated on its axis while being rotated together with balls under the frictional effect of the circular brush plate, at the same time causing the wash liquid in the wash chamber to circulate upwardly from below and further forcibly downwardly from above onto the golf balls thereby performing washing of the golf balls.

The object of the present invention is mainly to set up a golf ball washing machine of this invention at a golf link and to wash a plurality of soiled golf balls at one time very efficiently and in a very easy manner.

The accompanying drawings show one preferred embodiment of the present invention, wherein.

Figure 1:
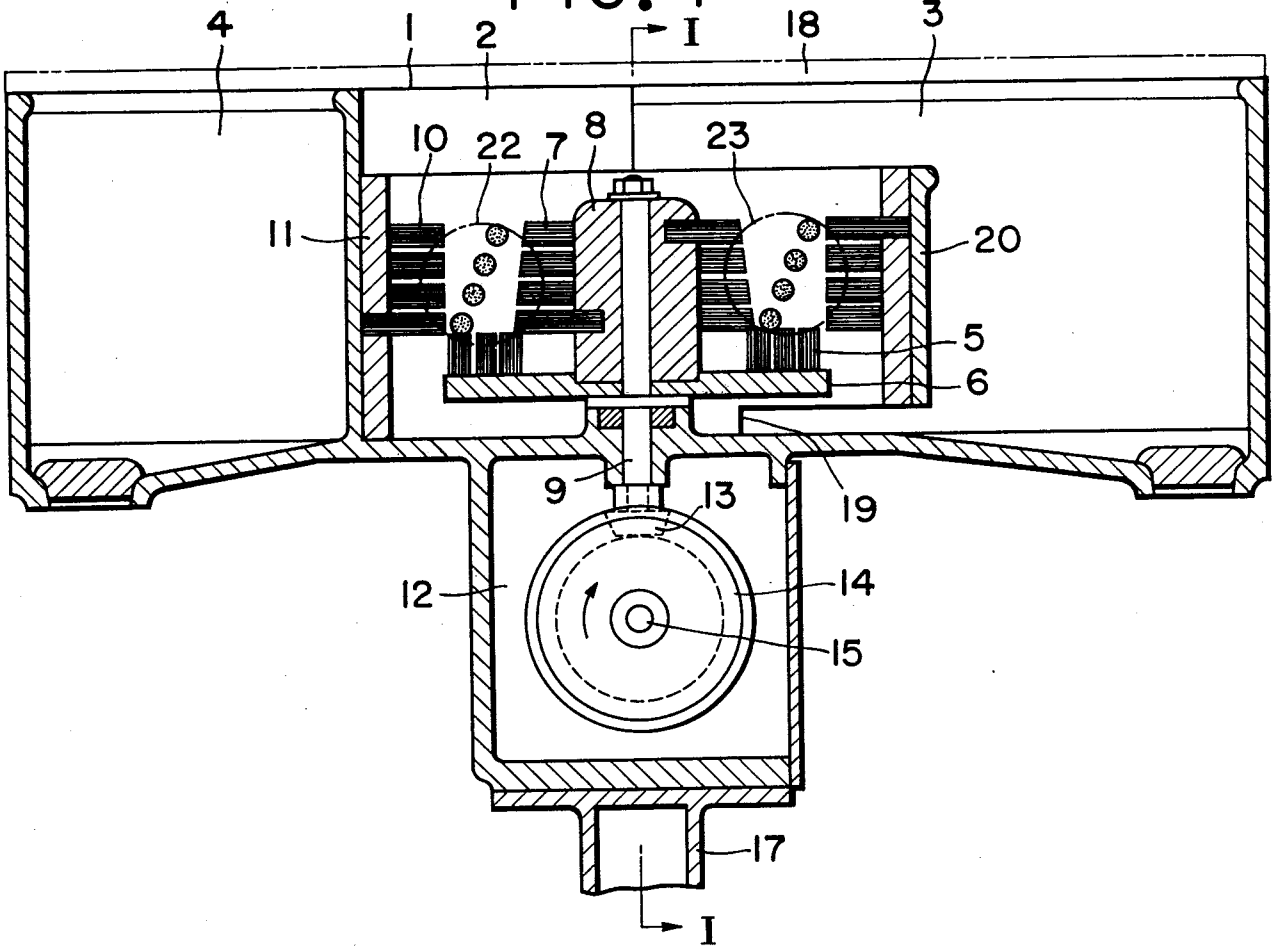
FIG. 1 is a longitudinal section of the golf ball washing machine according to this invention.
Figure 2:
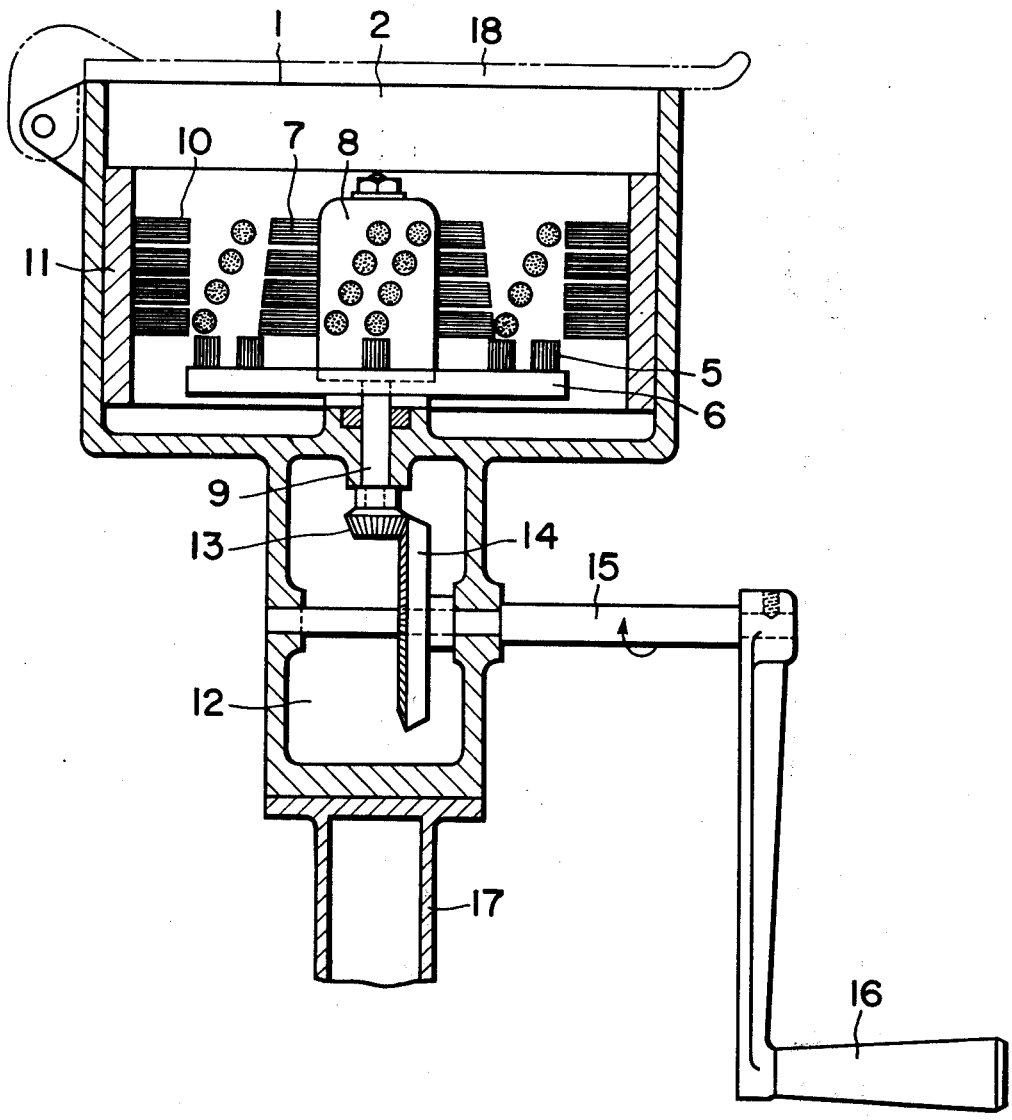
FIG. 2 is a sectional view taken along the line I — I FIG. 1.
Figure 3:
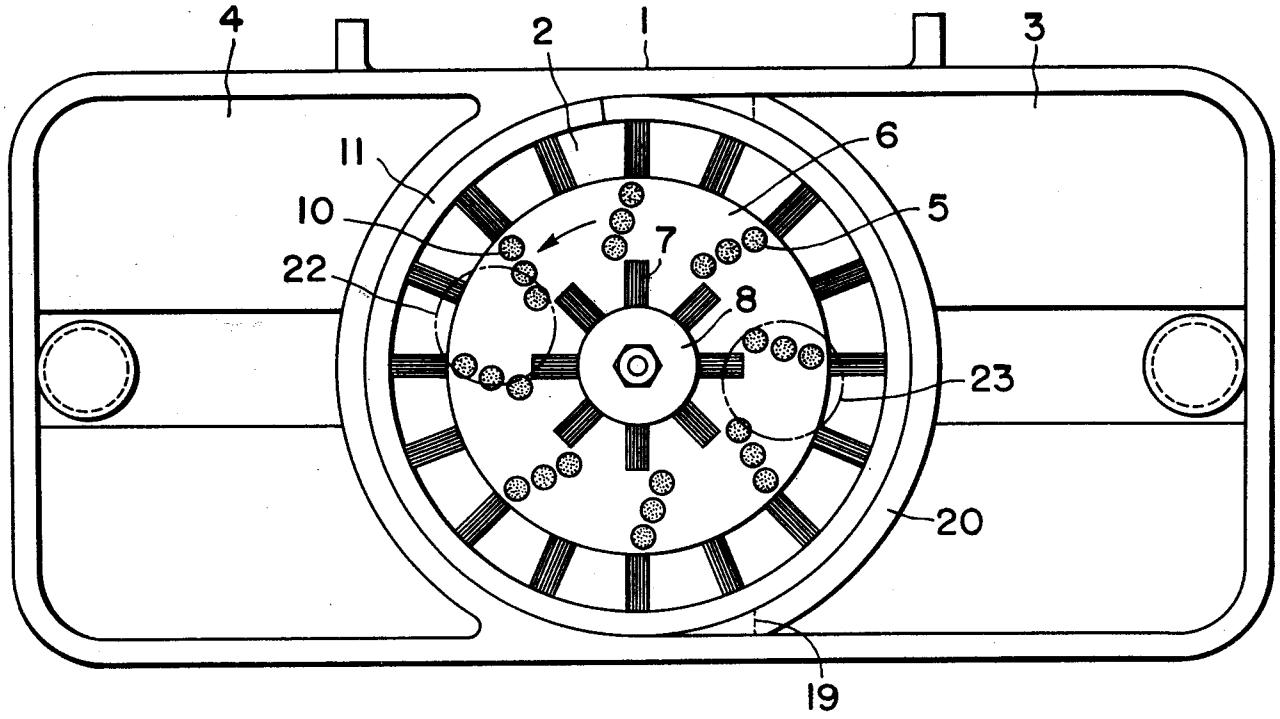
FIG. 3 is a plan view.
Figure 6:
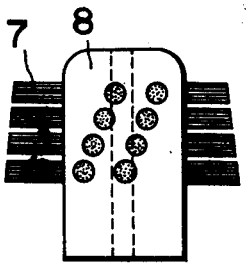
FIG. 6 is a side view of the central brush cylinder.
Figure 4:
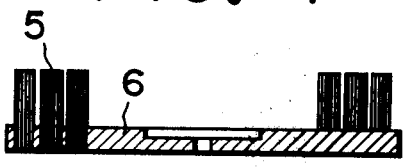
FIG. 4 is a sectional view taken along the line II—II of FIG. 5.
Figure 5:
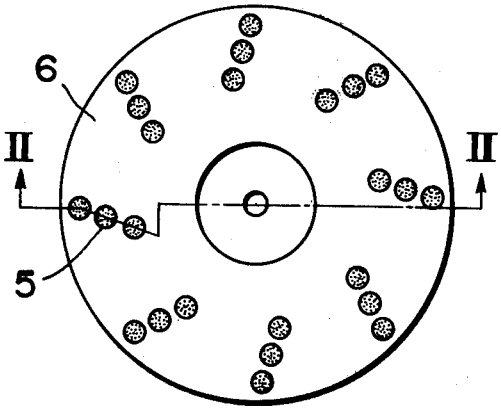
FIG. 5 is a plan view thereof.
Figure 7:
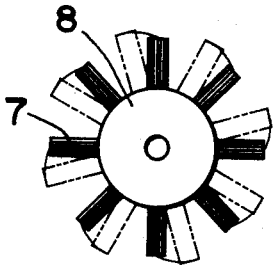
FIG. 7 is a plan view thereof.
Figure 8:
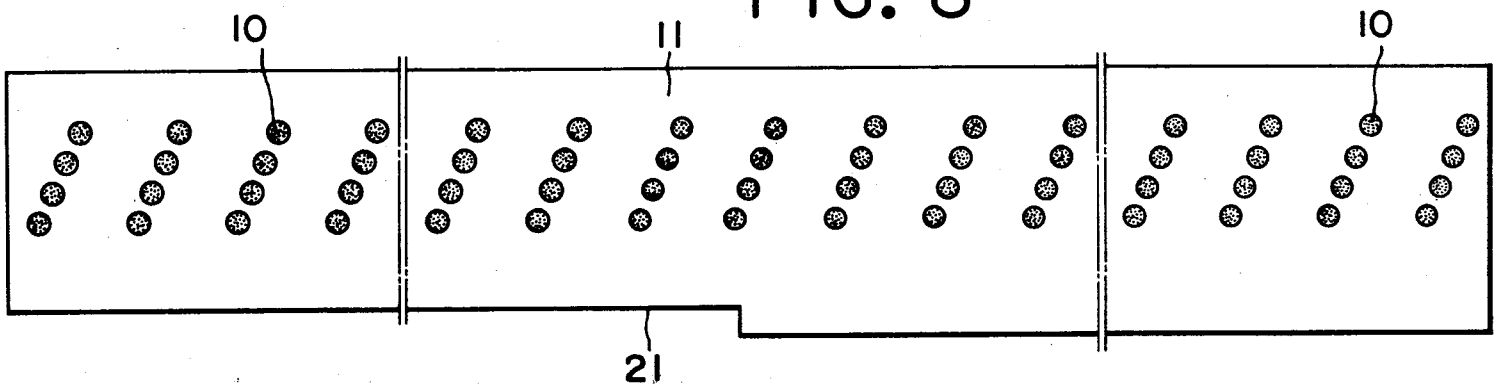
FIG. 8 is an expanded view of a belt-like brush plate for use in this invention.
Figure 9:
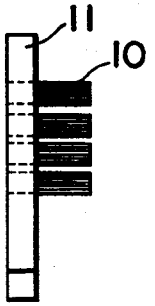
FIG. 9 is a side view thereof.

This invention will now be described in more detail by way of example shown in the accompanying drawings, in which a body 1 is divided into three rooms that is a golf ball wash chamber 2 at the central part and adjacent to both sides thereof a wash liquid chamber 3 and a fresh water chamber 4.

The wash chamber 2 is formed with a circular circumferential wall, and at the center of the chamber there is provided a lower brush disc 6 having a number of unit brushes 5 arranged in rows radially thereon with an inclination in one direction and a central brush cylinder 8 having a number of unit brushes 7 arranged in rows radially thereon with an inclination in one direction, both the brush disc 6 and brush cylinder 8 being mounted on a vertical rotary shaft 9, and facing around them there is removably attached to the inner circular wall of the wash chamber 2 a belt-like flexible brush plate made of e.g. rubber or plastic material and which has a number of unit brushes 10 arranged in rows radially thereon with an inclination in one direction.

Outside and below the wash chamber 2 there is formed integrally with the body 1 a gear box 12 in which are provided a small-diameter bevel gear 13 mounted on the vertical rotary shaft 9 and a larger-diameter bevel gear 14 for engagement with the bevel gear 13, the bevel gear 14 being mounted on a horizontal rotary shaft to the end of which is attached a handle 16. A stand 17 is secured to the under side of the gear box 12 to support the body 1, and a cover plate 18 is provided openably to the top of the body 1.

In FIG. 1, the reference numeral 19 indicates a wash liquid passageway provided under the partition wall 20 for the wash room 2 and wash liquid room 3, and accordingly the brush plate 11 is provided with a notched portion 21 so that it may not stand in the passageway 19.

Now, to describe the invention in connection with its operation, when the wash liquid such as soapsuds is introduced into the wash liquid chamber 3 it flows into the wash chamber 2 through the passageway 19 and is allowed to fill the room until the rising liquid level attains about one half of the unit brush groups 7, 10 arranged on the central brush cylinder 8 and the brush plate 11 in a vertical direction, or slightly higher than that level while the fresh water chamber 4 is filled with fresh water. Thereafter, golf balls 22, 23 are put in between the unit brushes 7 of the central brush cylinder 8 and the unit brushes 10 of the brush plate 11 and are pressed onto the unit brushes 5 of the lower brush disc 6. Then, the handle 16 is rotated resulting in the rotation of the central brush cylinder 8 together with the lower brush disc 6, thereby golf balls 22, 23 are rotated while making rotation round their own axis respectively under the effect of friction of the brushes 7, 5 and 10 with the balls. Here, the wash liquid in the wash chamber 2 is forced up outwardly by centrifugal force caused by the rotation of the unit brushes 7 of the central brush cylinder 8 and the unit brushes 5 of the lower brush disc 6. The wash liquid thus forced upwardly strikes against the unit brushes 10 of the brush plate 11 and splashingly falls down from the top portion of the unit brushes 10 onto the golf balls 22, 23 like a jet stream and washes the balls while circulating therein.

The golf balls 22, 23 thus washed are picked out of the wash chamber 2 and are put into the the fresh water chamber 4 for removing the wash liquid from the balls to thus finishing the washing of the balls.

As described above in detail, according to this invention golf balls are washed in relatively a short time since they are rotated together while making rotation each on their own axis in wash liquid circulating in the room like a jet stream. Furthermore, this invention has the advantage of washing a plurality of golf balls at one time and also of freely and separately replacing any of the brushes of the lower brush disc, the central brush cylinder and the belt-like brush plate since they are removably attached to their body respectively.

While a most pertinent embodiment of this invention has been described with reference to the accompanying drawings this invention is not to be restricted to the washing machine described above and modifications or changes may be possible without departing from the scope and spirit of this invention.

What I claim is:

1. A golf ball washing machine, comprising a body having a circular golf ball wash chamber at the center of which are rotatably provided a lower brush disc and a central brush cylinder coaxially therewith, the inner peripheral surface of said wash chamber being detachably provided with a flexible belt-like brush plate.

2. A golf ball washing machine according to claim 1, wherein the machine body is divided into three chambers i.e. a central circular wash chamber, a wash liquid chamber and a fresh water room respectively on both sides adjacent to said wash room, said wash liquid room being arranged to communicate with said wash.

3. A golf ball washing machine according to claim 1, wherein said belt-like brush plate is removably attached to the inner wall of said wash room, said brush plate being formed of rubber or plastic material and having a number of unit brushes disposed in rows thereon with an inclination in one direction.

4. A golf ball washing machine according to claim 1, wherein said lower brush disc has on its upper surface a number of unit brushes arranged in rows radially thereon with an inclination in one direction and said central brush cylinder has a number of unit brushes arranged in rows radially thereon with an inclination in one direction.

5. A golf ball washing machine according to claim 1, wherein said central brush cylinder and said lower brush disc are rotatably mounted on a vertically disposed shaft, said rotary shaft having a bevel gear mounted thereon, said bevel gear being disposed so as to engage with a bevel gear mounted on a horizontally disposed rotary shaft, the rotation of which enables said central brush cylinder and said lower brush disc to rotate.

* * * * *